US006132839A

United States Patent [19]

Reader

[11] Patent Number: 6,132,839

[45] Date of Patent: Oct. 17, 2000

[54] ALLOY FIBERS WITH REDUCED HEATSET SHRINKAGE

[75] Inventor: Arthur M. Reader, Enka, N.C.

[73] Assignee: BASF Corporation, Mt. Olive, N.J.

[21] Appl. No.: 09/205,392

[22] Filed: Dec. 4, 1998

[51] Int. Cl.[7] ..... D01F 6/00; D01F 8/00

[52] U.S. Cl. ..... 428/97; 428/364; 428/373

[58] Field of Search ..... 428/95, 97, 364, 428/373; 525/66, 71, 179

[56] References Cited

U.S. PATENT DOCUMENTS

| | | | |
|---|---|---|---|
| 3,793,822 | 2/1974 | Kawai | 57/140 |
| 4,296,022 | 10/1981 | Hudson | 260/42.46 |
| 4,711,812 | 12/1987 | Burns | 428/401 |
| 4,789,592 | 12/1988 | Taniguchi et al. | 428/373 |
| 4,822,678 | 4/1989 | Brody et al. | 428/373 |
| 5,130,372 | 7/1992 | Lences et al. | 525/183 |
| 5,284,009 | 2/1994 | Tung et al. | 428/97 |
| 5,372,885 | 12/1994 | Tabor et al. | 428/373 |
| 5,534,335 | 7/1996 | Everhart et al. | 428/224 |
| 5,602,200 | 2/1997 | Wissmann | 525/66 |
| 5,616,418 | 4/1997 | Vasselin et al. | 428/474.7 |
| 5,667,890 | 9/1997 | Ballard et al. | 428/364 |
| 5,683,818 | 11/1997 | Bolvari | 428/475.5 |
| 5,719,198 | 2/1998 | Young et al. | 521/40.5 |
| 5,738,745 | 4/1998 | Hudson et al. | 156/167 |
| 5,759,925 | 6/1998 | Ballard et al. | 442/199 |
| 5,849,844 | 12/1998 | Äärilä et al. | 525/66 |

FOREIGN PATENT DOCUMENTS 0 658 640 A1 10/1994 European Pat. Off. .

OTHER PUBLICATIONS

S.S. Dagli, M. Xanthos and J. A. Biesenberger, *Effects of Extrusion Parameters on the Morphology and Properties of Compatibilized Nylon 6/Polypropylene Blends*, Compalloy '91, pp. 257–276.

F. Ide and A. Hasegawa, *Studies on Polymer Blend of Nylon 6 and Polypropylene or Nylon 6 and Polystyrene Using the Reaction of Polymer*, *J. Appl. Polym. Sci.*, vol. 18, pp. 963–974 (1974).

S. J. Park, B. Y. Kim and H. M. Jeong, *Morphological, Thermal and Rheological Properties of the Blends Polypropylene/Nylon–6, Polypropylene/Nylon–6 (Maleic Anhydride–g–Polypropylene) and (Maleic Anhydride–g–Plolypropylene)/Nylon–6*, *Eur. Polym. J.*, vol. 26, No. 2, pp. 131–136 (1990).

F. P. Mantia, *Blends of Polypropylene and Nylon 6: Influence of the Compatibilizer, Molecular Weight, and Processing Conditions*, *Advances in Polymer Technology*, vol. 12, No. 1, pp. 47–59 (1993).

A. R. Padwa, *Compatibilized Blends of Polyamide–6 and Polyethylene*, *Polymer Engineering and Science*, vol. 32, No. 22, pp. 1703–1710 (1992).

*Primary Examiner*—Newton Edwards

[57] ABSTRACT

A carpet yarn is a plurality of fibers spun from a multiconstituent polymer alloy composed of 60 wt. % or more of nylon 6; up to about 37 wt. % of a stereoregular polyolefin having a melt flow index of from about 2 to about 100; and 3–37 wt. % of a polyolefin that is at least partially modified by one or more type of polar monomer. Upon steam heatsetting at about 124° C., the yarn shrinks less than about 20%.

14 Claims, No Drawings

ALLOY FIBERS WITH REDUCED HEATSET SHRINKAGE

FIELD OF THE INVENTION

The present invention relates generally to the field of synthetic fibers. More specifically, the present invention relates to the field of synthetic fibers spun from polymer alloys.

BACKGROUND OF THE INVENTION

Nylon 6 is commonly spun into fibers that are combined to make yarns that find use in such areas as carpeting and upholstery. Nylon 6 has physical properties that make it excellent for these end uses.

In some applications, especially in carpet applications, nylon 6 yarn is subject to heat treatment referred to as "heatsetting". Heatsetting confers dimensional stability and improved heat resistance (among other things) on the yarns subjected to it. For twisted plied yarns, heatsetting relieves mechanical twisting stresses, thus conferring improved twist retention and appearance retention to carpet made from such twisted yarns. The heatsetting process is known to cause nylon 6 yarns to shrink. It would be desirable to have a yarn displaying the advantageous nylon 6 characteristics, but with less heatset shrinkage.

Compatibilized blends of polyamides and other polymers have been spun into fibers. U.S. Pat. No. 5,759,925 to Ballard et al. describes fibers spun from blends of polyphenylene sulfide and polyamide compatibilized with modified polyolefins.

Polymer alloys of nylon 6, polyolefin and a compatibilizer have been studied extensively. Representative examples of such studies are presented in S. S. Dagli, M. Xanthos and J. A. Biesenberger, *Effects of Extrusion Parameters on the Morphology and Properties of Compatibilized Nylon 6/Polypropylene Blends,* Compalloy '91, pp. 257–276; F. Ide and A. Hasegawa, *Studies on Polymer Blend of Nylon 6 and Polypropylene or Nylon 6 and Polystyrene Using the Reaction of Polymer, J. Appl. Polym. Sci.,* Vol. 18, pp. 963–974 (1974); S. J. Park, B. Y. Kim and H. M. Jeong, *Morphological, Thermal and Rheological Properties of the Blends Polypropylene/Nylon-6, Polypropylene/Nylon-6 (Maleic Anhydride-g-Polypropylene) and (Maleic Anhydride-g-Polypropylene)/Nylon-6, Eur. Polym. J.,* Vol. 26, No. 2, pp. 131–136 (1990); F. P. Mantia, *Blends of Polypropylene and Nylon 6: Influence of the Compatibilizer, Molecular Weight, and Processing Conditions, Advances in Polymer Technology,* Vol. 12, No. 1, pp. 47–59 (1993); A. R. Padwa, *Compatibilized Blends of Polyamide-6 and Polyethylene, Polymer Engineering and Science,* Vol. 32, No. 22, pp. 1703–1710 (1992); U.S. Pat. No. 5,683,818 to Bolvari; and U.S. Pat. No. 5,719,198 to Young et al.

Blends of nylon and polyolefin have been extruded into fibers. U.S. Pat. No. 3,793,822 to Kawai describes a fishing net formed of monofilaments 200–2000 denier thick which are preferably made from polyamide blended with polypropylene.

Compatibilized alloys of nylon 6 and polypropylene have been spun into fibers. U.S. Pat. No. 4,822,678 to Brody et al. describes fibers spun from blends of polyamides and polyolefins that are compatibilized with a nylon 11. EPA 0 658 640 describes monofilaments spun from polyamide and polypropylene compatibilized with bonding agents, including maleated polypropylene.

SUMMARY OF THE INVENTION

It is an object of the present invention to provide a carpet yarn having the desirable properties of nylon 6 but less heatset shrinkage than nylon 6.

Another object of the present invention is to provide a carpet yarn that is delustered even in the absence of inorganic delustering agents.

These and related objects and advantages will become apparent to the ordinarily skill in the relevant art after reading the detailed description of the invention that is provided herein.

Accordingly, the present invention provides a carpet yarn composed of a plurality of fibers spun from a multiconstituent polymer alloy. The alloy is:

60 wt. % or more of nylon 6;

37–0 wt. % of a stereoregular polyolefin having a melt flow index of from about 2 to about 100; and 3–37 wt. % of a polyolefin that is at least partially modified by one or more type of polar monomer.

The yarn has a density per filament of from about 8 to about 40 denier. Upon steam heatsetting at about 124° C. the yarn shrinks less than about 20%. The said yarn is delustered even when it is substantially free from inorganic delusterants.

The preferred stereoregular polyolefins are syndiotactic polypropylene, isotactic polypropylene, copolymers thereof and blends thereof. The preferred partially modified polyolefins are maleated polypropylene, acrylated polypropylene, maleated ethylene/propylene rubber, maleated styrene/ethylene/butenelstyrene, and maleated anhydride grafted ethylene propylene-diene terpolymer.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended and that such alteration and further modification and such further applications of the principles of the invention as discussed are contemplated as would normally occur to one ordinarily skilled in the art to which the invention pertains.

As used herein, certain terms are intended to have certain meanings. The term "blend" refers to a mixture of two or more polymers while the term "alloy" means a sub-class of blends wherein the components are immiscible but have been compatibilized. "Miscibility" and immiscibility" refer to blends having negative and positive values, respectively, of the free energy of mixing. "Compatibilization" and similarly derived words refer to modifying the interfacial properties of a blend of immiscible polymers in order to make an alloy. Compatibilization can be "internal" such as by modifying at least one of the polymers or "external" by adding a compound that compatibilizes the otherwise immiscible blend. "Staple" or "staple fiber" means fibers that are short in length and, commonly, are spun to make a yarn (such as in the case of cotton or wool.) "Filament(s)" means fiber of extreme or indefinite length. "BCF" means bulked continuous filament yarns. The term "steam heatsetting" as used herein refers specifically to the heatsetting process that uses a heatsetting apparatus such as that available from Superba SA, 13 rue de Pfastatt, F-8060 Mulhouse, France.

All percentages are given by weight, unless some other unit is indicated. As described in more detail below in the test methods, melt flow index ("MFI") is in grams per 10 minutes at 230° C.

The present invention provides a carpet yarn which exhibits surprisingly improved heatset properties, specifically, reduced heatset shrinkage. The steam heatset shrinkage of the fiber is less than about 20%, more preferably, less than about 15%. In addition, the yarns of the present invention are naturally delustered, i.e., typical delustering additives (like $TiO_2$) need not be used. The multifilament yarn may have a total denier (linear density) of between about 400 and about 8000, and preferably between about 800 and 4000. It may be a plied yarn. The component fibers that make up the yarn have a density per filament of from about 4 denier to about 52 denier, and preferably from about 8 denier to about 40 denier.

The carpet yarn of the present invention is composed of a plurality of fibers spun from a multiconstituent polymer alloy. The fibers may be staple fibers, bulked continuous filaments ("BCF"), or a mixture of the two; but preferably are in the BCF form. The fibers of the present invention may have any cross-section commonly used in the art for carpet yarns, for example, deltoid, multilobal, pentagonal, etc. The fibers may have one or more axial voids. Further, the yarn of the present invention may be either a monocomponent or a multicomponent fiber, i.e., a fiber having more than one longitudinally co-extensive domains, such as a sheath-core, side-by-side, etc. arrangement. It is contemplated that the alloy could be either domain in such fibers, e.g., the sheath or the core, depending on the desired properties in the yarn, as will be understood by those of ordinary skill in the art.

The polymer alloys useful in the present invention include those which contain at least about 60% or more of polycaprolactam, commonly referred to as nylon 6. Most preferably, the alloy will contain at least 75% polycaprolactam. Suitable nylon 6 includes fiber-forming nylon 6 having a relative viscosity from about 2.4 to about 5.0, and preferably from 2.7 to 3.3. One such nylon 6 is available from BASF Corporation, Mt. Olive, N.J. as BS700, but any nylon 6 polymers of suitable relative viscosity for fiber-forming applications may be used, including modified nylon 6 polymers, e.g., sulfonated nylon 6 polymers, inherently heat- and light-stabilized nylon 6 polymers (such as polymers made through co-polymerization of caprolactam and hindered amine light stabilizers).

Another constituent of the alloy used in the present invention is a polyolefin that is at least partially modified by one or more type of polar monomer. Preferably the modified polyolefin will be present at from about 3% to about 37% of the alloy. More preferably, the alloy will contain at least 10% modified polyolefin and, most preferably, the alloy will contain at least 5% modified polyolefin. Suitable modified polyolefins include maleated polypropylene, acrylated polypropylene, maleated ethylene/propylene rubber, maleated styrene/ethylene/butene/styrene, maleated ethylene propylene-diene terpolymer, etc. The currently preferred modified polyolefin is maleated polypropylene having a preferred melt flow index from about 10 to about 5000, a more preferred melt flow index from 20 to about 1000 and a most preferred melt flow index of greater than 100. The selection of MFI will depend on the amount of modified polyolefin in the alloy. For example, if the alloy consists of nylon and modified polyolefin only, then the MFI of the maleated polyolefin preferably is in the range of about 10 to about 100 (but possibly could be lower, too). One useful maleated polypropylene is available from Aristech Chemical Company as Unite® MP-880.

A third constituent of the alloy used in the present invention is up to about 37% a stereoregular polyolefin having a melt flow index of from about 2 to about 100. More preferably, the alloy will contain at least 25 polyolefin and, most preferably, the alloy will contain at least 10% polyolefin. Suitable stereoregular polyolefins include syndiotactic polypropylene, isotactic polypropylene, and copolymers and blends of these. The preferred polyolefin is syndiotactic polypropylene or isotactic polypropylene. The most preferred polyolefin is isotactic polypropylene. Preferably, the melt flow index of the stereoregular polyolefin is from about 12 to about 45, and more preferably, from about 18 to about 38. One especially preferred polyolefin is available from Aristech Chemical Corporation, of Pittsburgh, Pa., as polypropylene D180F, which has a melt flow index of 18.

It is possible to have traditional amounts of functional additives blended into the alloy. Exemplary functional additives include flame retardants, antimicrobials, heat stabilizers, light stabilizers, pigments, dyes, antistatic agents, etc.

There is not considered any limitation on the method of making the alloy of the present invention and any method for making such compositions may be used. For example, the alloy fibers of the invention may be made by blending the component chips prior to or in the extruder. The fibers may also be made by compounding the components into alloy chips which are then fed to the extruder Alternatively, the alloy fiber may be made by adding the one or more of the polyolefin components into the extruder in a manner similar to the addition of, for example, pigments in the solution dying process. A remelt may be used.

As mentioned, the steam heatset shrinkage of the yarns of the present invention is less than the steam heatset shrinkage of yarns made from nominally 100% nylon 6. Nylon 6 by itself has a steam heatset shrinkage of about 25%, but, of course, the shrinkage actually observed will depend on the heatsetting temperature, pressure, etc. The degree of steam heatset shrinkage in the yarn of the present invention can be controlled by selecting the amounts of the component polymers.

The steam heatsetting process generally involves transporting several ends of ply-twisted BCF yarn on a perforated steel belt through a horizontal cylindrical continuous autoclave tunnel, which has sealing rolls at each end. Heatsetting takes place in the tunnel under an atmosphere of saturated steam under pressure. The continuous autoclaves are commonly nine (9) meters long although older machines may have six (6) meter long tunnels. There may also be peripheral units such as creels, an atmospheric pre-steamer, entry and exit cooling chambers, circulating blower fan for the tunnel, coiler head yarn feeder, stuffer box frieze texturizing yarn feeder, exit end accumulators, winders, etc.

Conditions for steam heatsetting yarn of the invention do not vary considerably from conditions for heatsetting conventional nylon 6 yarn. The conditions include autoclave tunnel temperatures from about 117 to 132° C., preferably about 124° C., residence time from 0.3 to 1.5 minutes, preferably about 35 seconds, belt mass from about 200 to 300 grams per meter, preferably about 225 grams per meter, with circulating blower system tunnel fan at 1000 rpm.

The invention will be described by referring to the following detailed Examples. These examples are set forth by way of illustration and are not intended to be limiting in scope. In the Examples, certain test methods are used as described below.

TEST METHODS

Relative Viscosity:

Relative viscosity is the ratio of the flow time of a 1% solution of nylon 6 polymer chip or fiber in 96% sulfuric acid to the flow time of 96% sulfuric acid through a capillary viscometer (e.g., Cannon Ubbelohde, II-type, size 200A)

under identical conditions. A test temperature of 25° C. is obtained by suspending the viscometer in a constant temperature bath. Flow times of polymer solution and solvent are measured in the capillary viscometer. The relative viscosity is the ratio of the flow times of solution to solvent. The formula is:

$$\eta rel.=T/T_0$$

where ηrel.=relative viscosity

T=flow time of the solution in seconds $T_0$=flow time of the solvent in seconds Melt Flow Index:

The melt flow index ("MFI") (also called melt flow rate ("MFR") in the literature) of polypropylene is measured according to ASTM Method D 1238 −95 under Condition 230/2.16 (at 230° C. under a total load, including the piston, of 2.16 kg). The units are in grams/10 minutes.

Steam Heatset Shrinkage:

The steam heatset shrinkage is measured in the Examples using the preferred nylon 6 heatsetting conditions: autoclave tunnel temperatures of about 124° C., residence time of about 35 seconds, belt mass of about 225 grams per meter, with circulating blower system tunnel fan at about 1000 rpm.

Shrinkage is calculated from the difference in linear density (e.g., denier) before and after steam heatsetting. The calculation is based on the following formula in which Dbhs is the BCF yarn denier before heatsetting, and $D_{ahs}$ is the BCF yarn denier after steam heatsetting.

$$\%\ \text{Steam Heatset Shrinkage}=100\times[(D_{ahs}-D_{bhs})/D_{bhs}]$$

The conditions selected are for illustration of the invention and should not be considered limiting. It is contemplated that other saturated steam heat-set methods, such as static autoclave heat-setting, could be used to obtain the same favorable reduced shrinkage of alloy BCF versus 100% nylon-6 BCF.

Boiling Water Shrinkage:

Boiling water shrinkage ("BWS") is measured according to ASTM method number D-2259-96 except that no wetting agent is added to the water bath. Additionally, the sample is not cooled in the bath. The results are presented in percent.

INVENTION EXAMPLE 1

Direct Extrusion of Alloy BCF Carpet Yarn

Polymer chips are introduced directly into the throat of a fiber extruder using a calibrated Colortronics™ volumetric ratio feeder with three automated feed hoppers. The dry chips are fed in the weight ratio of 85:10:5 of nylon-6 ("N"), polypropylene ("PP") and maleated polypropylene ("MPP"). The nylon 6 is 2.7 RV (BS700 available from BASF Corporation, Mt. Olive, N.J.). The polypropylene is 18 MFI (D180F available from Aristech Chemical Corporation, Pittsburgh, Pa.). The maleated polypropylene has 0.75% grafted maleic anhydride (0.75% succinic anhydride groups) and a MFI of 200 (MP-880 available from Aristech). The extruder is a 60 mm diameter single screw extruder with length to diameter ratio (L/D) of 24:1 fitted with 5 electrical zone heaters. It is followed by a metering pump and spin pack having sintered metal filtration as is known to those ordinarily skilled in the art of nylon fiber extrusion. The spin pack is fitted with a fiber spinneret having 58 trilobal holes. Temperature profile from zones 1 through 5 of the extruder (feed throat to delivery end) in degrees centigrade is 250, 265, 285, 285 and 280. Product temperature is 280° C. Pack pressure is 1800 psig. Metering pump delivery is about 310 grams/minute, with fine adjustments made to produce BCF yarn of 1100 total denier for the 58 filament yarn bundle after drawing, texturizing, air interlacing and winding.

Following extrusion the melted fibers dropped through a cross-flow quench chamber to solidify into undrawn continuous filament yarn. Quenching is in 13° C. air at an air-flow rate of about 61 cm/minute. The undrawn quenched CF yarn is drawn between a slow first godet roll and a fast second godet roll having respective temperatures of 50 and 165° C. and respective surface speeds of 1071 and 3000 m/minute, thus drawing at a ratio of 2.8.

The drawn yarn is then introduced into a hot air texturizer tube where it is subjected to turbulent air at a temperature of 230° C. and 7.5 bar pressure to convert it into BCF yarn. The bulked "plug" of BCF yarn exits the texturizing tube onto a perforated cooling drum which pulled ambient air through the hot textured plug under a vacuum of 11.9 cm of water. The cooled BCF yarn bundle is delivered to an interlacing jet at air pressure 6.5 bar to produce sufficient entanglement for subsequent yarn processing into tufted carpet or other end products. The BCF yarn is then wound onto cylindrical packages using a standard winder at about 2850 m/minute.

The boiling water shrinkage is 5.1%.

COMPARATIVE EXAMPLE 1

Nylon 6 BCF Carpet Yarn

A BCF control yarn of similar denier and cross-section is made from 100 percent nylon 6 using a substantially similar process to that described in Invention Example 1. However, the extruder barrel temperature profile is reduced to normal nylon processing conditions of 255, 255, 260, 260, 265 with product temperature of 265°.

The boiling water shrinkage of the nylon BCF yarns is 7.5%.

INVENTION EXAMPLE 2

Cable-twisted Alloy Yarn

The alloy BCF yarn of Example 1 is cable-twisted on a Volkmann VTS-05-C twister at 1.8 turns per cm (4.5 turns per inch) and subsequently continuously heat-set on a Superba machine. Following heatsetting, alloy BCF two-ply yarn has shrunken 9.1%.

COMPARATIVE EXAMPLE 2

Cable-twisted Nylon 6 Yarn

The nylon 6 BCF yarn of Comparative Example 1 is cable-twisted and heatset as described in Invention Example 2. Following heatsetting the nylon-6 BCF two-ply control yarn has shrunk 26.1%.

The tensile properties, as well as tufting and dyeing performance of both the alloy and the control yarn are similar. Finished tufted carpet produced from both alloy and control yarn performs satisfactorily and similarly in simulated and on-the-floor wear trials. Both carpets are also equally satisfactory with respect to colorfastness, lightfastness, gas fade (ozone and oxides of nitrogen), soil and stain resistance, and clean-ability.

INVENTION EXAMPLE 3

Extrusion of BCF Carpet Yarn From Compounded Alloy

A dry tumbled blend of polymer chips is fed in the weight ratio of 70:25:5 of nylon-6, polypropylene, and maleated polypropylene to a Werner-Pfleiderer 53 mm diameter, L/D ratio 40:1, approximately 2 meters long vented twin-screw compounding extruder. The maleated polypropylene has an MFI of 1000 and 1% grafted maleic anhydride (1% succinic anhydride groups) (Unite® MP-1000 available from Aristech). Compounding is done at 260° C. The molten polymer alloy blend is extruded through an eight hole die into cylindrical strands of about 0.32 cm diameter into a water bath at ambient temperature for quenching. Following the water bath, the strands pass between two suction tube dryers to remove tangible water. The strands then are fed to a cutter which cuts the strands into cylindrical alloy chips about 0.32 cm in length and 0.32 cm diameter. The alloy chips are dried under nitrogen in a tumble dryer at about 99° C.

This compounded alloy chip is extruded into 1100/58 denier BCF carpet yarn using the same equipment described in Example 1 with extruder barrel temperature profile of 255, 260, 265, and 270° C. Product temperature is 265° C. Pack pressure is 1800 psig.

Ply twisting, and Superba heat-setting are as described in Example 2. Shrinkage of the alloy BCF two-ply yarn during heatsetting is 7.2%.

The tensile properties, as well as tufting and dyeing performance of the alloy is similar to the control yarn. Finished tufted carpet produced from the alloy yarn performs satisfactorily and similar to control yarn in simulated and on-the-floor wear trials. Such carpets is also equally satisfactory with respect to colorfastness, lightfastness, gas fade (ozone and oxides of nitrogen), soil and stain resistance, and clean-ability.

INVENTION EXAMPLES 4–8

Preparation of Alloy BCF Yarns of Various Compositions

A series of alloy BCF singles yarns of similar linear density (denier), filament count, and cross-sectional profile to those of Invention Examples 1 and 3 are made. Singles yarn is tested for boiling water shrinkage and two ply cable-twisted BCF yarn is tested for Superba heatset shrinkage.

Data are presented in the Table.

TABLE

| Example | % N6 | % PP | % MPP | BWS (%) | Steam Heatset Shrinkage (%) |
|---|---|---|---|---|---|
| Comp. 1, 2 | 100 | 0 | 0 | 7.5 | 26.1 |
| Inv. 4 | 97 | 3 | 0 | 6.5 | 24.2 |
| Inv. 5 | 95 | 5 | 0 | 6.4 | 23.4 |
| Inv. 6 | 92 | 3 | 5 | 6.3 | 20.9 |
| Inv. 7 | 90 | 5 | 5 | 6.2 | 20.0 |
| Inv. 8 | 87 | 3 | 10 | 5.8 | 17.4 |
| Inv. 1,2 | 85 | 5 | 10 | 5.1 | 12.1 |
| Inv. 3 | 70 | 5 | 25 | 3.3 | 7.2 |

What is claimed is:

1. A carpet yarn comprising:

a plurality of fibers spun from a multiconstituent polymer alloy which alloy comprises:

60 wt. % or more of nylon 6;

37–0 wt. % of a stereoregular polyolefin having a melt flow index of from about 2 to about 100; and 3–37 wt. % of a polyolefin that is at least partially modified by one or more type of polar monomer, wherein said yarn has a denier per filament of from about 8 to about 40 and from steam heatsetting at about 124° C. said yarn shrinks less than 20%.

2. The yarn of claim 1 wherein said alloy comprises:

60 wt. % or more of nylon 6;

37–10 wt. % of a stereoregular polyolefin having a melt flow index of from about 2 to about 100; and 3–10 wt. % of a polyolefin that is at least partially modified by one or more type of polar monomer.

3. The yarn of claim 1 wherein said stereoregular polyolefin is selected from the group consisting of:

syndiotactic polypropylene;

isotactic polypropylene;

copolymers thereof; and blends thereof.

4. The yarn of claim 2 wherein said stereoregular polyolefin is selected from the group consisting of:

syndiotactic polypropylene;

isotactic polypropylene;

copolymers thereof; and blends thereof.

5. The yarn of claim 3 wherein said stereoregular polyolefin has a melt flow index of from about 12 to about 45.

6. The yarn of claim 4 wherein said stereoregular polyolefin has a melt flow index of from about 18 to about 38.

7. The yarn of claim 1 wherein said partially modified polyolefin is selected from the group consisting of:

maleated polypropylene;

acrylated polypropylene;

maleated ethylene/propylene rubber;

maleated styrene/ethylene/butene/styrene; and maleated anhydride grafted ethylene propylene-diene terpolymer.

8. The yarn of claim 2 wherein said partially modified polyolefin is selected from the group consisting of:

maleated polypropylene;

acrylated polypropylene;

maleated ethylene/propylene rubber;

maleated styrene/ethylene/butene/styrene; and maleated anhydride grafted ethylene propylene-diene terpolymer.

9. The yarn of claim 7 wherein said partially modified polyolefin is maleated polypropylene having a melt flow index of from about 10 to about 5000.

10. The yarn of claim 9 wherein said maleated polypropylene has a melt flow index of from about 20 to about 1000.

11. The yarn of claim 10 wherein said maleated polypropylene has a melt flow index of greater than 100.

12. The yarn of claim 1 wherein after steam heatsetting at about 124° C. said yarn shrinks less than 15%.

13. The yarn of claim 2 wherein after steam heatsetting at about 124° C. said yarn shrinks less than 15%.

14. A carpet comprising the yarns of claim 1.

* * * * *